United States Patent [19]

Nishioka

[11] Patent Number: 4,827,893

[45] **Date of Patent: * May 9, 1989**

[54] SHOOTING GUIDE FOR BOWS

[76] Inventor: Jim Z. Nishioka, 1268 Hemlock NW., Salem, Oreg. 97304

[ * ] Notice: The portion of the term of this patent subsequent to Sep. 29, 2004 has been disclaimed.

[21] Appl. No.: 12,364

[22] Filed: Feb. 9, 1987

[51] Int. Cl.[4] ..... F41B 5/02

[52] U.S. Cl. ..... 124/25; 124/22; 124/26; 273/416

[58] Field of Search ..... 124/41 R, 41 A, 22, 124/25, 24 R, 86, 81, 26; 273/416, 420, 423

[56] References Cited

U.S. PATENT DOCUMENTS

| | | | |
|---|---|---|---|
| 537,817 | 4/1895 | Coates | 124/25 |
| 1,192,639 | 7/1916 | Hunholz | 124/25 |
| 1,526,176 | 2/1925 | O'Connell . | |
| 2,125,591 | 8/1938 | Smith . | |
| 3,031,797 | 5/1962 | Gelfand . | |
| 3,483,857 | 12/1969 | Jones . | |
| 3,572,311 | 3/1971 | Baer . | |
| 3,949,729 | 4/1976 | Pfotenhauer | 124/22 X |
| 3,963,017 | 6/1976 | Pfotenhauer | 124/22 X |
| 4,027,645 | 6/1977 | Damron . | |
| 4,146,009 | 3/1979 | Adams . | |
| 4,291,664 | 9/1981 | Nishioka . | |
| 4,385,618 | 5/1983 | Nishioka . | |
| 4,446,844 | 5/1984 | Nishioka | 124/24 R X |

OTHER PUBLICATIONS

*The Crossbow Mediaeval and Modern Military and Sporting Its Construction, History & Management,* by Sir Payne-Gallwey (Holland Press, 1958), p. 219, FIGS. 158, 159.

Barnett International Inc. Advertisement.

*Primary Examiner*—Randolph A. Reese
*Assistant Examiner*—Anthony Knight

[57] ABSTRACT

A combination of a shooting bow and a guide assembly is provided for use with a projectile. The bow includes an elongated frame. The guide assembly is connected to the frame and includes a guide member for slidably supporting and guiding the projectile. The guide member includes a top portion and extends longitudinally in a shooting direction of the bow's bowstring. The guide assembly also includes a control member which also extends longitudinally in the shooting direction of the bow's bowstring. The control member controls upwardly movements of the projectile during its sliding movements on the top portion of the guide member. The control member leaves a substantial portion of the top portion of the guide member open.

4 Claims, 2 Drawing Sheets

SHOOTING GUIDE FOR BOWS

FIELD OF THE INVENTION

This invention relates to new and useful improvements in projectile shooting guides and projectiles for bows.

SUMMARY OF THE INVENTION

According to the present invention and forming primary objectives thereof, shooting guides and projectiles for bows are provided having novel structural arrangements.

Prior structures employ guides which guide short projectiles past the bow frame, however, such structures are complex and expensive to manufacture. Some prior structures employ projectiles which are launched from the top of the guide member, however, no provision is made to ensure that the projectile will not leave the guide member prematurely when it is shot.

Prior projectiles employ nocks which can be engaged to a bowstring in only two positions. The operator must align the projectile to one of the two positions to engage it to the bowstring.

An objective of the present invention is to provide a simple and economical means to restrict a projectile's upward movement while allowing it to slide forwardly on top of the guide member when it is shot.

Another objective of the present invention is to provide a guide member which will guide a short projectile as well as guide a conventional arrow.

Still another objective of the present invention is to provide an optional cover for the guide member to protect it from the elements.

Another objective of the present invention is to provide a projectile with more than two positions to engage a bowstring.

The invention will be better understood and additional objectives and advantages will become apparent from the following description taken in connection with the accompanying drawings.

DETAILED DESCRIPTION OF PREFERRED EMBODIMENTS

Figure 1:
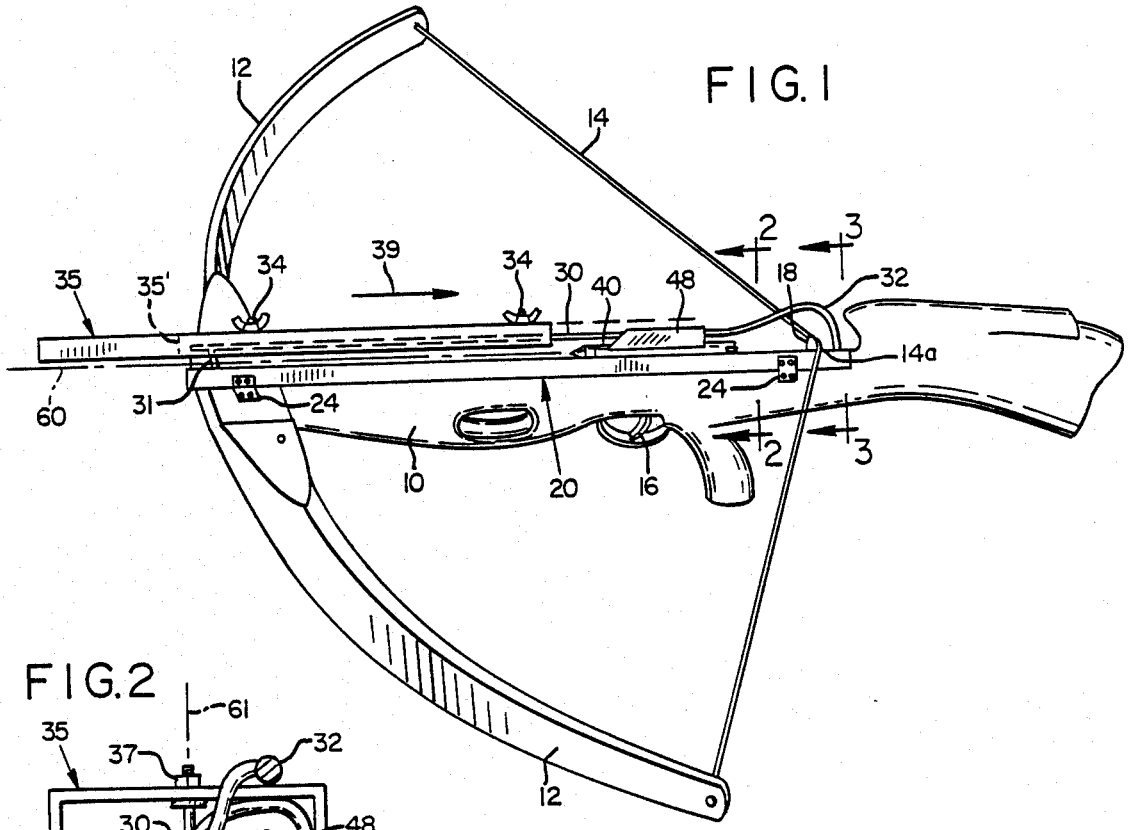
FIG. 1 is a perspective view of the bow and a first form of shooting guide and projectile embodying principles of the present invention.

The shooting guides and projectiles of this invention illustrated in the drawings are shown associated with an archery bow of the crossbow type. However, it is to be understood that the structural principles involved in the shooting guides and projectiles of this invention may be employed with archery bows other than crossbows.

With particular reference to the drawings and first to FIGS. 1-9, there is shown an archery bow having a frame or stock 10 and a prod 12 or other forms of tensioning means. A bowstring 14 is connected to the prod 12 and includes an arrow or projectile engaging portion **14*a*. The bow has a trigger 16 and a nut or bowstring catch 18. The catch is of conventional construction and is shown broken away in FIGS. 3, 4 and 5** for illustration purposes to more clearly show related parts.

The shooting guide includes an elongated guide member 20 which includes an elongated base portion **20*a* and elongated wall portions 20*b* connected to such base portions. The guide member also includes an elongated raised portion 20*c* which is positioned on the base portion. The raised portion includes elongated ribs or strips 21 which extend longitudinally along the raised portion. The ribs reduce friction between the projectile 40 and the guide member when the projectile is shot. An elongated slot 22 extends downwardly into the raised portion. The guide member is connected to the stock 10 by a pair of plates 24**.

The shooting guide also includes an elongated bar 30 which allows a projectile to slide on top of the guide member 20 while restricting such projectile's upwardly movement when it is shot. A forward portion of the bar is connected to a forward portion of the guide member by a connecting portion 31. A rearward portion of the bar is connected to a rearward portion of the guide member by a connecting portion 32. The is elongated and extends longitudinally and substantially parallel to the guide member. The bar and the connecting portions are shown in rod-like form, however other shapes and forms, such as plates, strips or the like, may be employed to accomplish the same function. Furthermore, the bar and the connecting portions may be constructed of one piece as shown or constructed of separate pieces and still function as intended.

Figure 6:
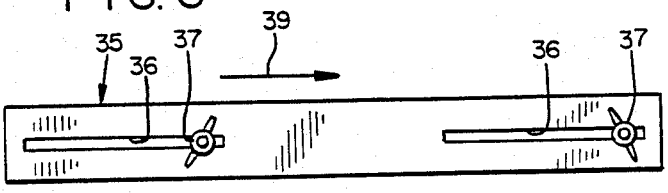
FIG. 6 is an overhead view of a cover for the guide member.

A cover 35 also is provided and is slidably attached to the guide member 20. The sliding feature of the cover is best seen in FIG. 6. A pair of elongated slots 36 and a pair of wing nuts and studs 37 allow the cover to slide forwardly forloading a projectile and also to slide rearwardly to a closed position for shooting a projectile A line 39 indicates a direction of sliding movement to close the cover. The wing nuts and studs secure the cover to the bar 30. The cover protects the guide member from dust and also is useful during adverse weather conditions such as rain or snow. Also, if desired, the shooting guide can be constructed without the bar 30 and the cover connected directly to the connecting portions 31 and 32. When the bar is not employed, the cover will function to restrict or control the projectile's upwardly movement during its forwardly sliding movement when it is shot. The cover is shown in an open forwardly position for illustration purposes. The rearwardly shooting position of the cover is indicated by a broken line 35'. The cover is positioned transversely to and over the bowstring 14.

Figure 7:
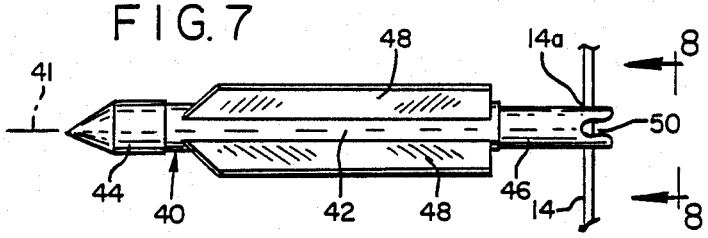
FIG. 7 is a side elevational view of a projectile with a 4-way nock.
Figure 8:
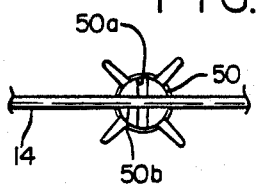
FIG. 8 is an end view of the nock shown in FIG. 7 taken on line 8—8.

A preferred construction of a projectile 40, best seen in FIGS. 7 and 8, includes a body portion 42, a head portion 44, a rearward portion 46, and wing portions 48. A pair of wing portions extends upwardly and outwardly from the body portion. Another pair of wing portions extends downwardly and outwardly from the body portion.

A nock 50 is positioned on the rearward portion and includes a pair of bowstring slots **50*a* and 50*b* for engaging the bowstring 14**. Such slots allow the projectile to be engaged to the bowstring in four different positions which makes nocking the projectile faster and more convenient. Most prior projectiles have only one slot and can be engaged to a bowstring in only two positions. The slots are aligned between the wing portions in this embodiment of the projectile. The projectile head may be made of metal to provide more mass to help stabilize the projectile in flight. The body portion is suitable for plastic molding. The nock also is suitable for plastic molding and can be bonded to the body portion in a desired alignment during manufacture.

During shooting movements of the projectile 40 on the guide member 20, the connecting portions 31 and 32 position the bar 30 over the body portion 42 and the head portion 44 of the projectile. Furthermore, the bar is aligned between the wing portions 48 of the projectile during such shooting movements.

When the projectile 40 is positioned on the guide member 20, a substantial portion of the projectile is positioned on top of the guide member. Also, when the projectile is positioned on the guide member, the raised portion **20*c*** of the guide member is positioned below a substantial portion of such projectile.

The projectiles 40 and 40' may be constructed without the body portions 42 and 42' and the rearward portions 46 and 46' respectively. Such projectiles would comprise the head portions 44 and 44' and the wing portions 48 and 48' respectively.

Figure 9:
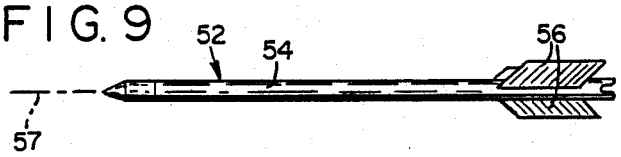
FIG. 9 is a side elevational view of a conventional arrow.

A conventional arrow 52 is shown in FIG. 9 and includes a shaft 54 and fletching 56. A line 57 indicates a vertical center of the arrow.

The shape of the connecting portion 32 shown in FIG. 1–4, which is connected to the rearward portion of the bar 30 and the rearward portion of the guide member 20, allows the projectile 40 to be loaded onto the rearward portion of the guide member. The connecting portion arches upwardly, rearwardly and laterally for easy loading of the projectile. The projectile also may be loaded through the front of the guide member. The shape of the connecting portion 31, which is connected to the forward portion of the bar and the forward portion of the guide member, allows a wing portion of the projectile to pass freely under such forward connecting portion.

The projectile 40 can lift slightly during sliding movements on the guide member 20, however, the bar 30 restricts and limits such upwardly movement of the projectile to prevent it from lifting completely off the guide member and escaping the confines of the guide member and the bar. This is a very important feature of the invention. Without such control during the projectile's sudden acceleration by the bowstring, the projectile could leave such confines and cause injury.

Another very important feature of the shooting guide is the simplicity of concept and design which will keep parts and manufacturing costs to a minimum.

Still another important feature of the present shooting guide is that, during loading operations, the projectile 40 is positioned on top of the guide member 20 and is highly visible and easily grasped.

The raised portions **20*c* and 20*c'* of the guide members 20 and 20', respectively, slidably support and vertically position the projectile 40** and also control the projectile's lateral movements on the guide member when it is shot. This is a very important feature of this invention.

The raised portions **20*c* and 20*c'* each comprise a pair of opposite sides which extend substantially straight upwardly a short distance before sloping upwardly and inwardly for engaging the bottom sides of the downwardly and outwardly extending wing portions of the projectile 40**.

Furthermore, the projectile 40 is supported on the raised portions **20*c* and 20*c'* by the head portion 44 and the undersides of the downwardly and outwardly extending wing portions. This provides good guiding control of the projectile when it slides forwardly on such raised portions. This features also allows the projectile to be constructed without the body portion 42 or the rearward portion 46**. This is useful in maintaining uniform wall thickness when the projectile is molded of plastic or other suitable material. Still futhermore, if desired, the sides of the raised portions may be spread apart so that the head portion of the projectile will not engage the raised portions.

The sloping angles of the tops of the raised portions **20*c* and 20*c'*, shown in FIGS. 2–5, terminate near the base portions 20*a* and 20*a'*. Furthermore, the raised portions slidably support the projectile 40** so that the bottom edges of the downwardly and outwardly extending wing portions of the projectile do not engage the base portions of the guide member. This desirable feature allows projectiles with slightly damaged wing portion edges to be shot without causing undue friction. The projectiles can be easily damaged if they strike a hard object when shot. Still furthermore, the outer edges of the wing portions do not guide the projectile in the guide member, therefore, such damaged wing portions do not materially impair the projectile's alignment in the guide member.

Figure 4:
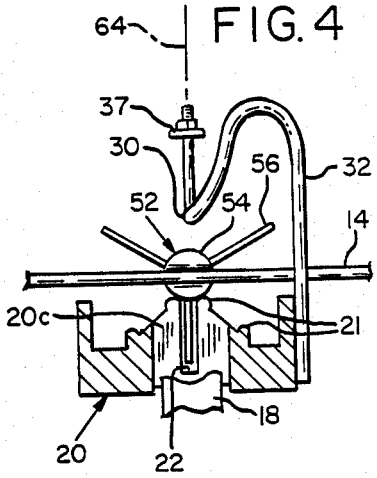
FIG. 4 is an enlarged fragmentary sectional view of the shooting guide similar to that of FIG. 3 but shown with an arrow in shooting position.

FIG. 4 shows the shooting guide with the conventional arrow 52 loaded onto the guide member 20 and engaged to the bowstring 14. The arrow shaft 54 rests on the raised portion **20*c* of the guide member and one of the arrow's fletchings extends downwardly into the slot 22. This shows that the shooting guide is capable of shooting the conventional arrow 52 as well as the short projectile 40**.

Both connecting portions 31 and 32 are connected to the same side of the guide member 20. This leaves one side of the guide member open which allows easy loading of the conventional arrow 52 or the projectile 40.

Figure 5:
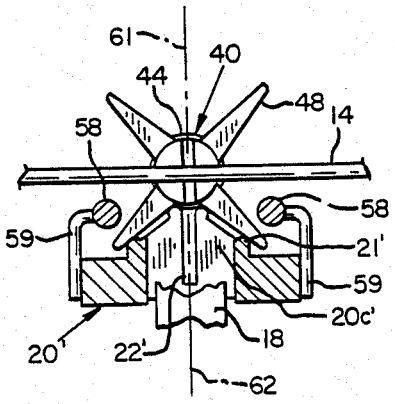
FIG. 5 is an enlarged fragmentary sectional view of a modified form of shooting guide embodying principles of the present invention.

A modification of the invention is shown in FIG. 5 and includes a pair of elongated bars 58 which extend longitudinally along and above the guide member 20'. The bars are connected to the guide member by a pair of connecting portions 59.

Figure 2:
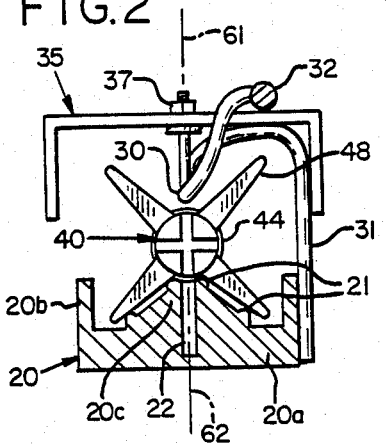
FIG. 2 is an enlarged fragmentary sectional view of the shooting guide taken on line 2—2 of FIG. 1.
Figure 3:
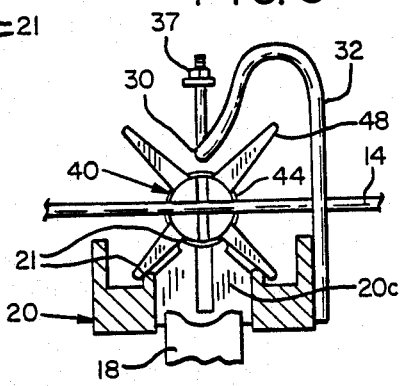
FIG. 3 is an enlarged fragmentary sectional view of the shooting guide taken on line 3—3 of FIG. 1.

The guide member 20' includes a raised portion **20*c'*, a slot 22' and ribs or strips 21' which function in a manner similar to the raised portion 20c, the slot 22 and the ribs 21 shown in FIGS. 2, 3 and 4. The elongated bars 58 may be constructed in various forms, such as plates, rods, and the like, which perform the same function. The connecting portions 59** also may be constructed in various forms, such as plates, rods, and the like, which perform the same function. The connecting portions may extend along the guide member in a continuous form or be constructed in an intermittent form as shown.

The bars 58 are positioned below a substantial portion of the projectile 40. This feature provides a shooter with an unobstructed sighting plane down the projectile and the top of the guide member 20. The bars are positioned on opposite sides of the guide member. The connecting portions 59 position the bars inwardly towards a horizontal center of the guide member. When the projectile is positioned on the guide member the bars extend over a pair of downwardly and outwardly extending wing portions of the projectile. Furthermore, the bars extend under a pair of upwardly and outwardly extending wing portions of the projectile.

The bars 58 allow easy loading of the projectile 40 and also provides good visual exposure of the projectile when it is positioned on the guide member 20'. The bars also allow free sliding movements of the projectile on the guide member while restricting and controlling its upwardly movement when it is shot.

Referring to FIG. 1, line 60 indicates a pathway in the guide member occupied by the projectile 40 when it is loaded and shot. Referring to FIG. 2, line 61 indicates a horizontal center of the projectile 40 and line 62 indicates a horizontal center of guide member 20. Referring to FIG. 4, line 64 indicates a horizontal center of the conventional arrow 52.

A projectile with three wing portions also may be employed with one of the wing portions extending down into the slot 22 in a manner similar to the conventional arrow and fletching shown in FIG. 4. The elongated bar 30 would extend between two of the wing portions to control upwardly movement of such projectile.

Referring to FIGS. 10–14, still another modification of shooting guide is shown. An archery bow includes a frame 70, an arrow shelf 72, and a bowstring 74. The bowstring is connected to a tension means. Such tension means is not shown but could include a pair of conventional flexible bow arms. The shooting guide is slidably supported on the frame by a support 76.

The shooting guide includes a slidable guide member 78. A sliding movement of the guide member is indicated by an arrow 79. The guide member includes a slot 80 which engages a projection 82 on the support 76. A pair of elongated ribs or strips 83 extends along the top of the guide member 78. The ribs reduce friction between the wing portions of a projectile 40' and the guide member when such projectile is shot.

The projectile 40' includes a body portion 42', a head portion 44', wing portions 48', a nock 50' and bowstring slots 50a' and 50b'. This projectile is similar to the projectile 40 shown in FIG. 7 except that during manufacture the bowstring slots 50a' and 50b' were aligned with the wing portions 48' rather than between such wing portions.

The shooting guide of this embodiment includes an elongated bar 84 for allowing the projectile 40' to slide on the guide member 78 while restricting its upward movement during such sliding movements. A forward portion of the bar is connected to a forward portion of the guide member by a connecting portion 85. A rearward portion of the bar is connected to a rearward portion of the guide member by a connecting portion 86. The bar is elongated and extends longitudinally and substantially parallel to the guide member. The bar and the connecting portions are shown in rod-like form, however, other shapes and forms may be employed to accomplish the same function. Furthermore, the bar and the connecting portions may be constructed of one piece as shown or constructed of separate pieces and still function as intended.

The bar 84, the projectile 40' and the guide member 78 slide rearwardly together and in unison with the bowstring 74 during a drawing movement of the shooting guide. The shape of the connecting portion 86 allows the projectile to be loaded onto the rearward portion of the guide member. The shape of the connecting portion 85 allows a wing portion of the projectile 40' to pass freely under such connecting portion. The connecting portion positions the bar over one of the wing portions of the projectile.

Figure 12:
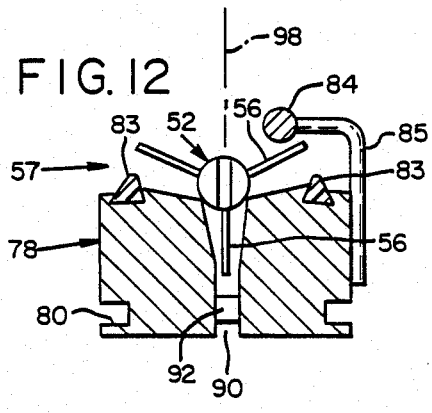
FIG. 12 is an enlarged fragmentary sectional view of the shooting guide with the arrow in shooting position.
Figure 11:
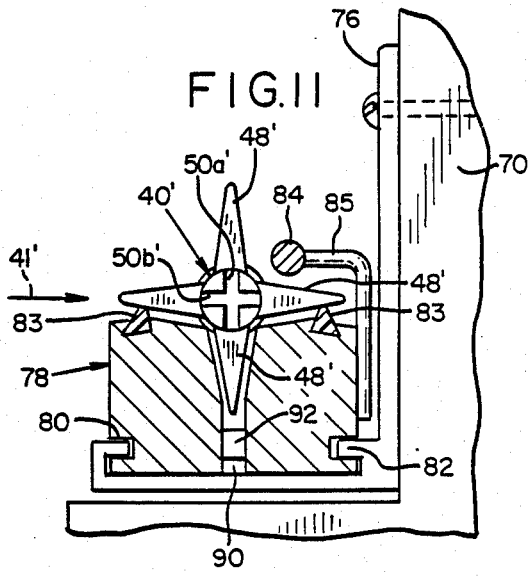
FIG. 11 is an enlarged fragmentary sectional view of the shooting guide taken on line 11—11 of FIG. 10.
Figure 13:
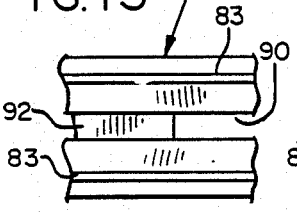
FIG. 13 is an overhead enlarged fragmentary view of the guide member taken on line 13—13 of FIG. 10.
Figure 14:
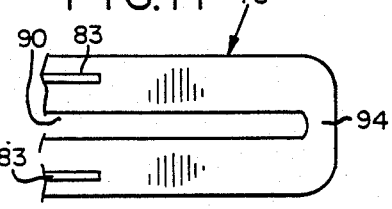
FIG. 14 is an overhead enlarged fragmentary view of the guide member taken on line 14—14 of FIG. 10.

A bowstring slot 90 in the guide member 76 allows the bowstring 74 to move freely in the guide member during drawing and shooting movements. The upper portion of the slot 90 is wider to accommodate one of the wing portions of the projectile 40' as seen in FIG. 11. The slot also receives one of the fletchings of the conventional arrow 52 as seen in FIG. 12. The forward portion of the guide member includes a web 92 which forms a forward wall for the slot and a web 94 forms a rearward wall for the slot. Such webs connect the opposite parallel portions of the guide member. This can be best seen in FIGS. 13 and 14.

In FIG. 12 the conventional arrow 52 is shown positioned on the guide member 78. This shows that the shooting guide of this embodiment, similar to that shown in the embodiments of FIG. 1 and FIG. 5, can shoot either a conventional arrow or a short projectile while controlling upwardly movement of a projectile when it is shot from the guide member.

The bar 84, similar to the bar 30 shown in FIG. 1, is very simple and easy to use. This concept keeps parts to a minimum and should keep manufacturing costs down.

The top of the guide member 78 slopes downwardly towards the slot 90.

The shooting guide of this embodiment restricts and limits the upwardly movement of the projectile 40' when it is accelerated on the guide member by the bowstring 74. This control of the projectile during shooting movements on the guide member is an important safety feature.

When the projectile 40' is positioned on the guide member 78, a substantial portion of the projectile is positioned on top of such guide member. A horizontal center of the guide member is indicated by a line 98.

The raised portions 20c and 20c', shown in FIGS. 2 and 5, respectively, extend upwardly between a pair of downwardly and outwardly extending wing portions of the projectile 40 which is positioned on top of the guide members 20 and 20', respectively. Such raised portions slidably support and align the projectile when the shooting guide is shot.

The embodiments of the shooting guides shown in this disclosure are suitable for use with projectiles with three wing portions. When such three-wing projectiles are employed, one of the wing portions may extend down into either slots 22 or 90 of the guide members 20 or 78 respectively.

Figure 10:
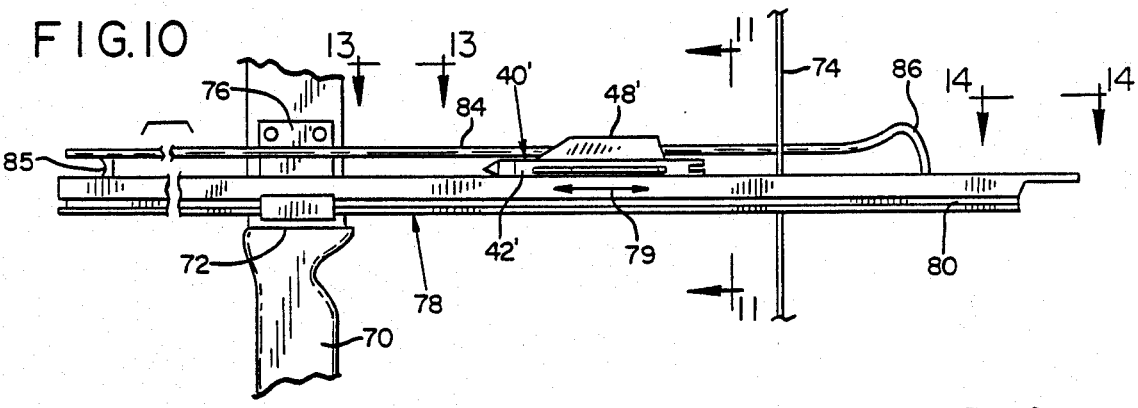
FIG. 10 is a side elevational view of a modified form of shooting guide embodying principles of the present invention.

The guide members and 20 and 20' shown in FIGS. 1 and 5, respectively, may be modified and used with the bow shown in FIG. 10. Furthermore, the guide member 78 shown in FIG. 10 may be modified and used with the bow shown in FIG. 1.

Devices, other than the ribs or strips 21, 21' and 83 shown in FIGS. 2, 5 and 11, respectively, may be employed to accomplish the same function. Furthermore, such ribs are optional, and when deleted, the raised portions of the guide members 20, 20' and 78 would support the projectiles 40 and 40'.

The vertical centers of the projectiles 40 and 40' indicated by lines 41 and 41' seen in FIGS. 5, 7 and 11, respectively, are positioned above the raised portions 20c and 20c' of guide members 20 and 20' and guide member 78. Such vertical centers of the projectiles are positioned above the wall portions of the guide members. Furthermore, the vertical centers of the projectiles are positioned above the bars 58 of the shooting guide shown in FIG. 5.

The rearward portion of one of the bars 58 and one of the connecting portions 59 of the shooting guide shown in FIG. 5 may be modified to pivot laterally toallow easy loading of the projectile 40 onto the rearward portion of the guide member 20'.

The elongated ribs or strips 21 and 21' shown in FIGS. 2-5 and the ribs or strips 83 shown in FIGS. 11-14 reduce friction between the projectile and the guide members. The ribs 21 and 21' are shown as part of the guide members 20 and 20' respectively, and ribs 83 are shown as separate pieces dove-tailed into the guide member 78. Such ribs 83 may be constructed of plastic or other suitable friction-reducing material. Reducing friction will increase projectile speed and reduce noise when such projectile is shot.

It is to be understood that the forms of my invention herein shown and described are to be taken as preferred examples of the same and that various other changes in the shape, size and arrangement of parts may be resorted to without departing from the spirit of my invention, or the scope of the subjoined claims.

Having thus described my invention, I claim:

1. In combination, a shooting bow and a guide assembly, the combination for use with a projectile which includes forward and rearward portions, the shooting bow including an elongated frame, a pair of arms with tip ends with at least one of the arms being flexible for providing tension in a bowstring, the arms being connected to the frame, and a bowstring extending between the tip ends of the arms, the guide assembly operatively connected to the bow, said guide assembly including an elongated guide member extending longitudinally in a shooting direction of the bowstring, said guide member for slidably supporting and guiding a projectile, said guide member including means for positioning the projectile for engaging the bowstring, said guide member including an elongated top portion, said top portion being substantially open to allow easy grasping of the projectile when it is loaded onto the top portion of the guide member, at least a substantial portion of the projectile being positioned above and parallel to the top portion of the guide member when the projectile is in the loaded position on the top portion of the guide member, said guide assembly also including control means, said control means extending longitudinally in the shooting direction of the bowstring, said control means for controlling upwardly movements of the projectile when the latter is loaded onto the top portion of the guide member, said control means allowing the projectile to slide on the top portion of the guide member, so that during operation of the combination, the projectile is first loaded onto the top portion of the guide member and engaged to the bowstring and when the bowstring is drawn and released the control means will control the projectile's upwardly movements as it is propelled forwardly by the bowstring, said control means including a forward portion and a rearward portion, a portion of the rearward portion of the control means extending outwardly and away from a lateral center of the guide member for providing access to the guide member for loading the projectile.

2. In combination, a shooting bow and a guide assembly, the combination for use with a projectile which includes forward and rearward portions, the shooting bow including an elongated frame, a pair of arms with tip ends with at least one of the arms being flexible for providing tension in a bowstring, the arms being connected to the frame, and a bowstring extending between the tip ends of the arms, the guide assembly operatively connected to the bow, said guide assembly including an elongated guide member extending longitudinally in a shooting direction of the bowstring, said guide member for slidably supporting and guiding a projectile, said guide member including means for positioning the projectile for engaging the bowstring, said guide member including an elongated top portion, said top portion being substantially open to allow easy grasping of the projectile when it is loaded onto the top portion of the guide member, at least a substantial portion of the projectile being positioned above and parallel to the top portion of the guide member when the projectile is in the loaded position on the top portion of the guide member, said guide assembly also including control means, said control means extending longitudinally in the shooting direction of the bowstring, said control means for controlling upwardly movements of the projectile when the latter is loaded onto the top portion of the guide member, said control means allowing the projectile to slide on the top portion of the guide member, so that during operation of the combination, the projectile is first loaded onto the top portion of the guide member and engaged to the bowstring and when the bowstring is drawn and released the control means will control the projectile's upwardly movement as it is propelled forwardly by the bowstring, the projectile used with said combination including multiple elongated wings extending along the rearward portion of the projectile, the multiple wings including a pair of upwardly extending wings, said control means being positioned to extend between the pair of upwardly extending wings of the projectile when the latter is loaded onto the top portion of the guide member.

3. The combination of claim 2 wherein when the projectile used with said combination also includes a downwardly extending wing, said guide member also including an elongated slot for receiving the downwardly extending wing of the projectile so that when the latter is loaded onto the top portion of the guide member the control means will be positioned to extend between the two upwardly extending wings and the downwardly extending wing will extend into the slot.

4. In combination, a shooting bow and a guide assembly, the combination for use with a projectile which includes forward and rearward portions, the shooting bow including an elongated frame, a pair of arms with tip ends with at least one of the arms being flexible for providing tension in a bowstring, the arms being connected to the frame, and a bowstring extending between the tip ends of the arms, the guide assembly operatively connected to the bow, said guide assembly including an elongated guide member extending longitudinally in a shooting direction of the bowstring, said guide member for slidably supporting and guiding a projectile, said guide member including means for positioning the projectile for engaging the bowstring, said guide member including an elongated top portion, said top portion being substantially open to allow easy grasping of the projectile when it is loaded onto the top portion of the guide member, at least a substantial portion of the projectile being positioned above and parallel to the top portion of the guide member when the projectile is in a loaded position on the top portion of the guide member, said guide assembly also including control means, said control means extending longitudinally in the shooting direction of the bowstring, said control means for controlling upwardly movements of the projectile when the latter is loaded onto the top portion of the guide member, said control means allowing the projectile to slide on the top portion of the guide member, so that during operation of the combination, the projectile is first loaded onto the top portion of the guide member and engaged to the bowstring and when the bowstring is drawn and released the control means will control the projectile's upwardly movement as it is propelled forwardly by the bowstring, said guide member also including forward, middle and rearward portions, said control means leaving a substantial portion of said top portion of said guide member open so that when the projectile is positioned on said middle portion of said top portion of said guide member is can be grasped for convenient movement, when the projectile used with said combination includes a pair of downwardly extending wings, said control means extending over said pair of downwardly extending wings, said control means being positioned below said bowstring and also below a substantial portion of the projectile.

* * * * *